United States Patent [19]

Hurley et al.

[11] Patent Number: 4,796,600

[45] Date of Patent: Jan. 10, 1989

[54] GAS WALL OVEN

[75] Inventors: James E. Hurley, Allentown; Robert H. Stettler, Reading, both of Pa.

[73] Assignee: Raytheon Company, Lexington, Mass.

[21] Appl. No.: 49,498

[22] Filed: May 14, 1987

[51] Int. Cl.[4] ..... A21B 1/00

[52] U.S. Cl. ..... 126/273 H; 126/273 R; 126/21 R; 126/77

[58] Field of Search ..... 126/273 A, 273 R, 21 R, 126/21 A, 77

[56] References Cited

U.S. PATENT DOCUMENTS

| | | | |
|---|---|---|---|
| 2,839,044 | 6/1958 | Phares | 126/273 A X |
| 3,333,530 | 8/1967 | Reuther | 126/273 R X |
| 3,915,149 | 10/1975 | Kemp | 126/273 R X |
| 4,598,691 | 7/1986 | Herrelko et al. | 126/21 R X |

*Primary Examiner*—Larry Jones

*Attorney, Agent, or Firm*—William R. Clark; Richard M. Sharkansky

[57] ABSTRACT

A pyrolytic self-clean gas wall oven having a bake and broil burner wherein a baffle separates the secondary air supply for the bake burner from the broil burner primary combustion air flow path so that, when the broil burner is off, combustion products from the bake burner are prevented from recirculating back to the bake burner via the broil burner and its primary combustion air supply path. Further, the oven has fans for moving cooling air around the outside to limit the external surface temperatures. The cooling air and the combustion air have independent flow paths so that the flame characteristics are not affected. The oven may have two oven compartments each with its own bake and broil burners.

11 Claims, 4 Drawing Sheets

GAS WALL OVEN

BACKGROUND OF THE INVENTION

The present invention relates to gas fueled ovens and particularly to built-in wall ovens having pyrolytic self-cleaning capability.

Built-in wall ovens are generally encased on all sides except for the front. Because of the proximity or contact with adjacent and supporting structures which are often wood, the outer surface temperatures of a built-in wall oven must be strictly limited so as to prevent household damage or even fire. With conventional built-in wall ovens that do not have the self-clean feature, sufficient insulation has been an acceptable solution to limiting external surface temperatures because the temperature of the oven compartment typically does not exceed 500°-550° F. However, during a pyrolytic self-clean cycle, the oven compartment is elevated to temperatures in the range from 900°-1100° F. for several hours. Under these extreme conditions, the use of insulation alone is not generally practical for a wall oven. Because of the very high temperatures, a significant amount of heat would pass through any practical type and thickness of insulation, and, with the confinement of a built-in wall oven, extremely hot and perhaps damaging external surface temperatures could be reached.

Attempts have been made to overcome the above-described problem by encasing built-in wall ovens with a spaced jacket or outer casing that creates an air chamber surrounding the oven compartment. A fan has been used to force air through the chamber so as to remove substantial amounts of heat which pass through the insulation layer. In this way, the temperature of the jacket or casing is limited. With electric built-in wall ovens, this technique has proved successful, and many such self-cleaning electric wall ovens have been manufactured.

With gas self-clean wall ovens, there are additional problems. In U.S. Pat. No. 4,375,213, it was recognized that the forced cooling air in the external air chamber could extinguish a gas pilot if one were used, and further, steps were taken to isolate the primary and secondary combustion air from the cooling air so as to provide favorable burning characteristics. However, if there is a bake and broil burner, isolating the primary and secondary air together could result in combustion products from the bake burner being recirculated through the broil burner back to the bake burner when the broil burner is off.

SUMMARY OF THE INVENTION

It is an object of the invention to provide improved burning in a gas pyrolytic self-clean wall oven having bake and broil burners.

It is also an object to provide a gas pyrolytic self-clean wall oven that has sufficiently cool outer surfaces so as to prevent damage to adjacent and supporting wall members.

Further, it is an object to provide a flow of cooling air around the outside of an oven compartment of a gas pyrolytic self-clean wall oven while at the same time isolating the cooling air from combustion air to the burners, and isolating the primary combustion air flow path to the broil burner so that the combustion products from the bake burner are prevented from recirculating back to the bake burner via the broil burner and its primary combustion air flow path.

These and other objects and advantages are provided by the invention which defines a gas wall oven comprising an oven compartment comprising a top, bottom, side and back walls, and a door, a burner box proximate the bottom, a first burner positioned in the burner box, means for providing secondary combustion air to the burner box, a second burner proximate the top, and means for channeling primary combustion air to the second burner, the providing means being substantially isolated from the channeling means to prevent first burner combustion products from recirculating through the second burner and the channeling means back to the first burner when the first burner is activated and the second burner is off. It may be preferable that the secondary combustion air providing means comprise apertures in the burner box communicating with the front of the oven. Also, it may be preferable that the primary air channeling means comprise a vertical duct running along one of the side walls and communicating with the front of the oven at the bottom. Further, it may be preferable that the oven also include a barrier wall or baffle between the duct and the underside of the burner box.

The invention may also be practiced by a self-clean gas wall oven comprising an oven compartment comprising a top, bottom, side and back walls, and a door, a burner box proximate the bottom, a bake burner positioned in the burner box, a first passageway for providing a flow of secondary combustion air to the burner box for the bake burner, a broil burner positioned proximate the top, a duct for providing a flow of primary combustion air to the broil burner, and means for preventing bake burner combustion products from recirculating through the broil burner and duct back to the bake burner when the broil burner is deeactivated. It may also be preferable that the first passageway and duct both draw air from the front underside of the oven compartment, and the preventing means comprise a partition or baffle between the flow paths of the secondary combustion air for the bake burner and the primary combustion air for the broil burner.

The invention further defines a self-cleaning gas wall oven comprising an oven compartment comprising a top, bottom, side and back walls, and a door, a burner box positioned below the bottom and communicating with the compartment, a first burner positioned in the burner box for providing comcombustion products for flowing into the compartment, a chamber positioned below the burner box, the burner box having a plurality of apertures for communicating with the chamber, the chamber communicating with the outside front of the oven for providing secondary combustion air through the apertures into the burner box for the first burner, a second burner proximate the top, a duct external to the oven compartment for providing primary combustion air from below the compartment to the second burner, and means positioned between the duct and the air chamber for substantially preventing first burner combustion products from recirculating back to the first burner via the second burner and the duct when the second burner is off. Preferably, the preventing means may comprise a vertical partition separating the input of the duct from the air chamber. Further, the invention may include a second oven compartment having first and second burners.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
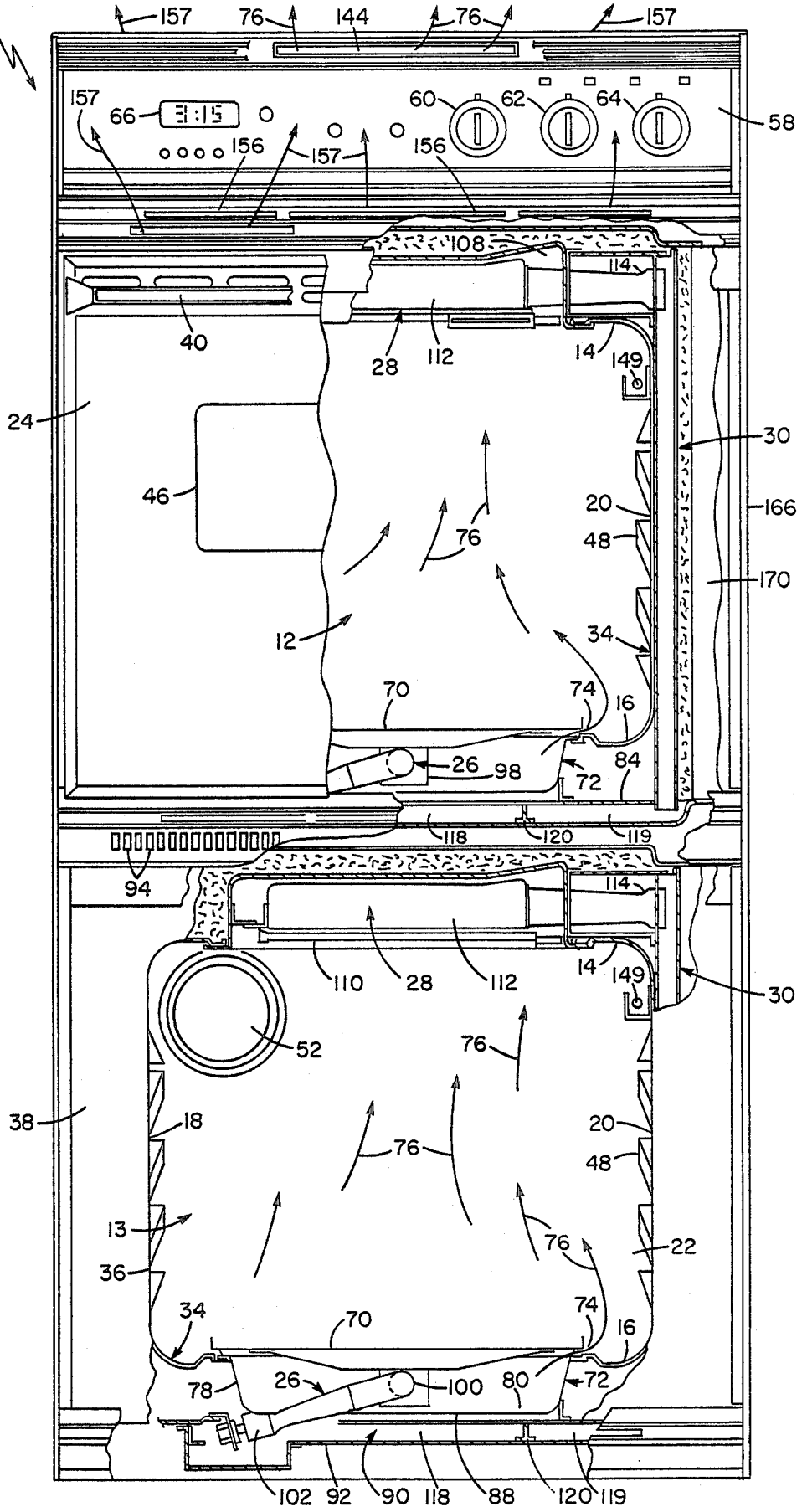
FIG. 1 is a partially broken-away front view of a self-clean gas wall oven having two oven compartments.

Referring to the drawings wherein like characters of reference designate like parts throughout the several views, the present invention defines a built-in wall oven 10 having an oven compartment 12 or cavity with a top 14, bottom 16, side walls 18 and 20, a back wall 22 and a door 24. A bake burner 26 is positioned proximate the bottom 16 and a broil burner 28 is positioned proximate the top 14. A duct 30 channels primary combustion air to the broil burner 28, and it is isolated by partition 120 from the flow of secondary air 32 to the bake burner 26 so that, when the bake burner 26 is on and the broil burner 28 is off, combustion products from the bake burner 26 are prevented from recirculating back through the broil burner 28 to the bake burner 26.

Figure 2:
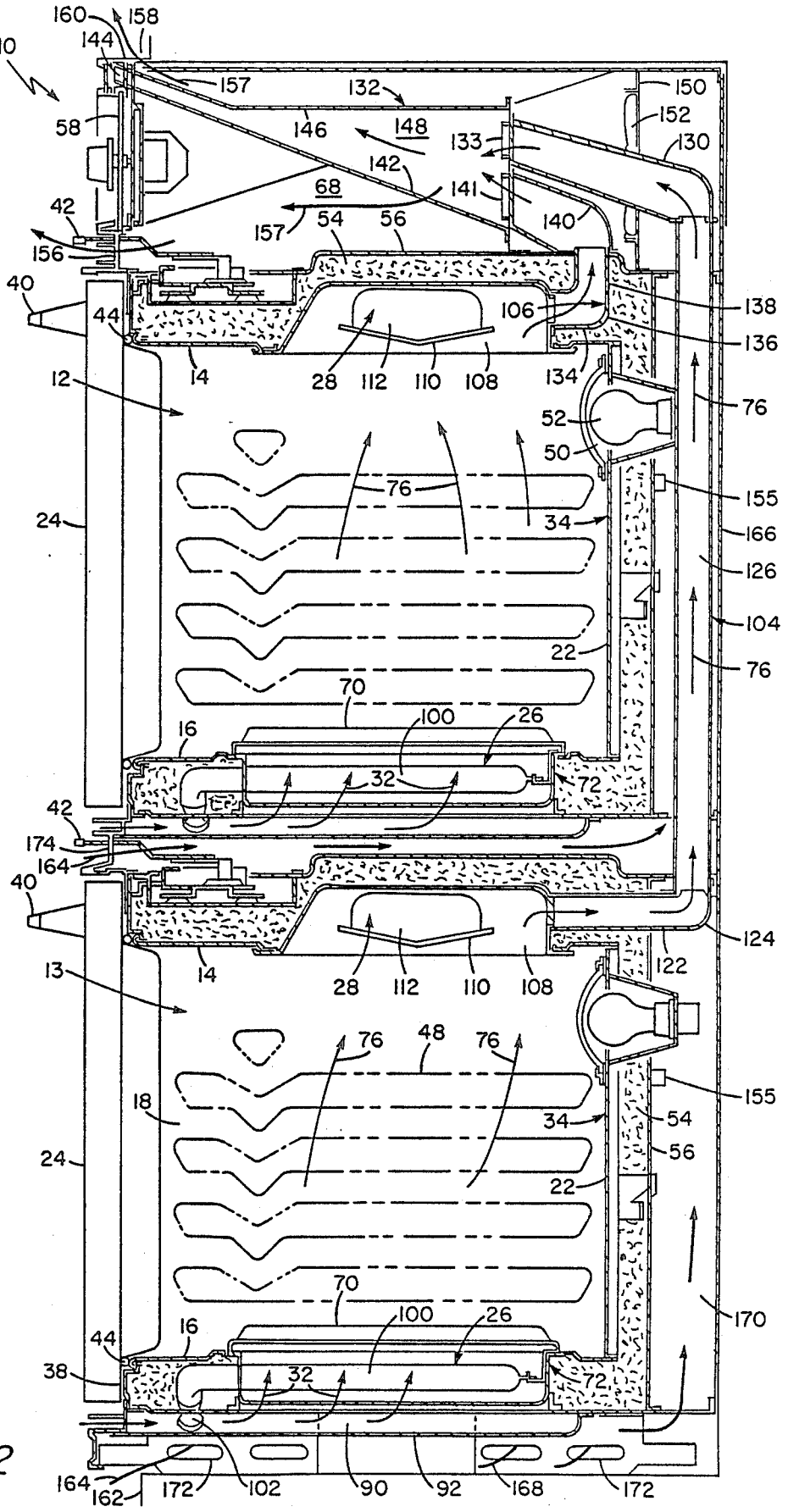
FIG. 2 is a side sectioned view of the oven of FIG. 1.

With reference to FIGS. 1 and 2, there are shown partially broken-away front and side sectioned views of a built-in gas self-cleaning double wall oven 10 using the invention to advantage. In the present description, it is believed unnecessary to show and describe well-known and conventional parts such as gas lines, gas valves and controls, ignitors, control lines, etc. since they do not in themselves constitute any part of the present invention. Double wall oven 10 here includes an upper cooking compartment 12 and a lower cooking compartment 13. These compartments 12 and 13 or cavities are substantially the same, and therefore a generalized description of one compartment will be sufficient for the other. Accordingly, like reference numerals have generally been used for the corresponding parts of both compartments 12 and 13. Each compartment 12 and 13 includes a substantially box-shaped metal liner 34 which defines a top wall 14, a bottom wall 16, a pair of side walls 18 and 20, and a back wall 22. The interior surfaces of liner 34 may be fabricated in conventional manner such as, for example, by applying a layer of porcelain enamel (not shown). The oven or cooking compartments 12 and 13 are accessed through respective openings 36 which are closed by doors 24 which are seated up against face plates 38. Each door 24 is mounted on the front by suitable hinges (not shown) whereby the door is pivotably movable using handle 40 into an open or closed position. As is conventional with pyrolytic self-clean ovens, latches 42 are provided to lock the doors closed, and thermal gaskets 44 seal the compartments 12 and 13 so that the self-cleaning temperatures can be reached.

Doors 24 are preferably filled with insulation and may be provided with a heat resistant transparent window 46 for viewing the oven cooking compartments 12 and 13. Also, air may be circulated through doors 24 to help keep them cool during operation. The side walls 18 and 20 of the cooking compartments 12 and 13 have contoured regions to form side shelves 48 for supporting metal racks (not shown). Also, the back wall 22 of each compartment 12 and 13 may have an aperture 50 for mounting a light 52. The top walls 14, bottom walls 16, side walls 18 and 20, and back walls 22 are surrounded by insulation 54 which is encased on the opposite side by suitable retaining walls 56.

Located above upper cooking compartment 12 is a control panel 58 which includes control knobs 60, 62, and 64 for controlling the operation of both compartments 12 and 13 during such operative modes as bake, broil, and self-clean. Also, control panel 58 may preferably include a clock 66. A plenum 68 located behind control panel 58 houses control components (not shown).

The bottom wall 16 or bottom of each cooking compartment 12 and 13 includes a removable cover 70 which seats over a burner box 72 and has spacings 74 or openings at the lateral sides for permitting combustion products 76 to flow into the respective oven compartments 12 and 13. More specifically, referring to FIG. 4, there is shown a perspective view which includes burner box 72 or combustion cavity which has four sides 78 and a floor 80 with elongated apertures 82. Burner box 72 seats on horizontal metal panel 84 which has a large hole 86 as shown best in FIG. 3. Accordingly, the underside 88 of burner box 72 communicates with combustion air chamber 90 which is formed by horizontal metal panel 84 on the top and enclosure panel 92 on the bottom, sides and back. Enclosure panel 92 may be connected to panel 84 using spot welds 85. Combustion air chamber 90 communicates outside the bottom front of the respective cooking compartments 12 and 13 through slots 94. Accordingly, secondary combustion air 32 for burner box 72 flows through slots 94, combustion air chamber 90, and elongated apertures 82.

Figure 4:
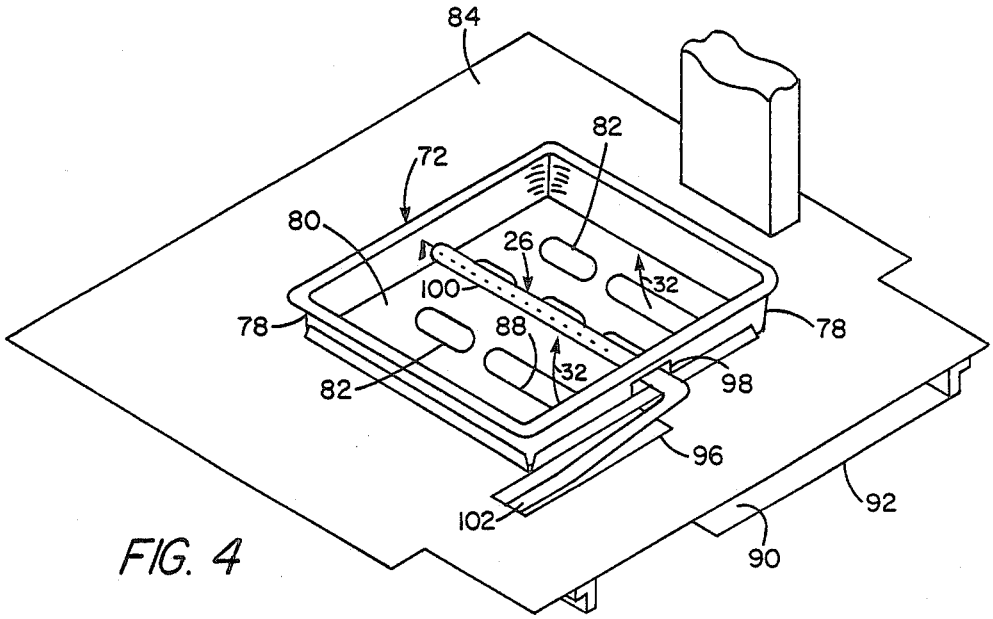
FIG. 4 is the apparatus of FIG. 3 further including a burner box and bake burner.

As shown in FIGS. 1, 2, and 4, bake burner 26 extends from air chamber 90 through aperture 96 in horizontal metal panel 84 into burner box 72 through aperture 98 therein. Bake burner 26 extends a substantial distance from the front to the rear of burner box 72 or burner cavity. Preferably, bake burner 26 is a conventional blue flame type burner which includes a ported burner head 100 and a gas receiving chamber for receiving gaseous fuel from a venturi 102 or the like. As is well known, a gas carrying pipe (not shown) is routed to venturi 102. Primary combustion air travels to venturi 102 via slots 94 and into air chamber 90 where venturi 102 is positioned. A suitable ignitor (not shown) would also be used. The combustion products 76 from bake burner 26 flow through spacings 74 into respective cooking compartments 12 and 13 for heating in the bake and self-clean modes. As an example, bake burner 26 may produce approximately 15,500 Btu per hour. The combustion products 76 from the lower oven compartment 13 exit through flue pipe 104, and the combustion products 76 from the upper oven compartment 12 exit through flue pipe 106.

Figure 3:
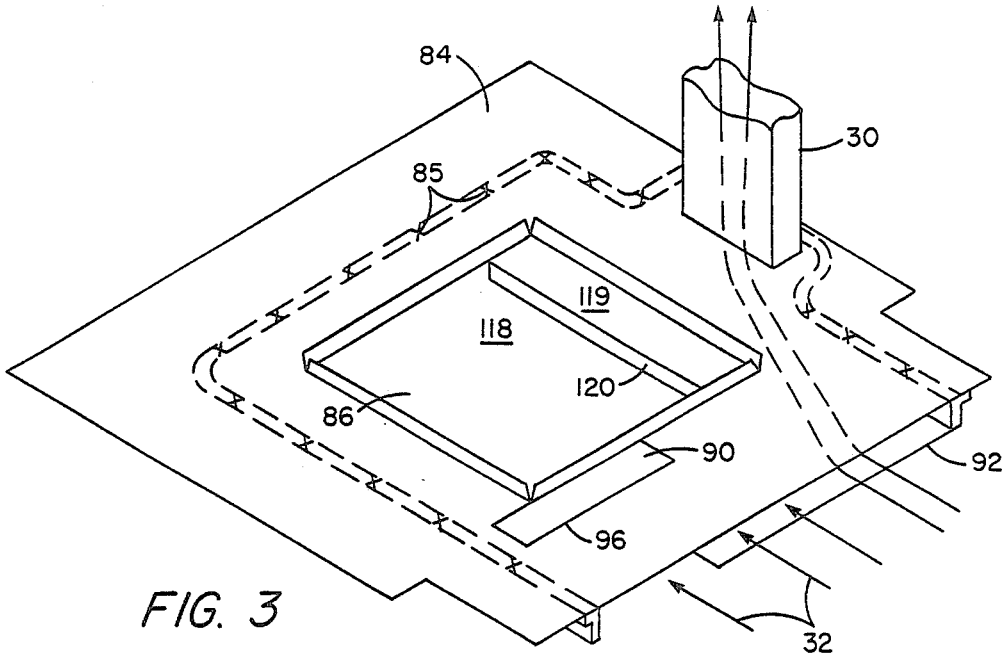
FIG. 3 is a front perspective view of the region underneath the bottom of an oven compartment.

The respective tops 14 of oven compartments 12 and 13 have recessed regions 108 in which broil burners 28 are mounted. Preferably, broil burners 28 are of the type known as radiant burners wherein a broad sheet of flame heats an underscreen 110 to an incandescent temperature which provides the radiant heat. One example of a radiant burner of a type suitable for use in the self-clean oven of the present invention is that disclosed in U.S. Pat. No. 3,122,197. Such radiant burner 28 includes a burner head 112 defining an open-sided cavity and a mixing chamber such as a venturi 114 adapted to receive gas from a pipe (not shown). The mixing chamber of radiant burner 28, for efficient and rapid combustion, is required to receive an ample supply of primary combustion air from duct 30. For example, ten parts of air to one part of gas is considered to be one satisfactory ratio in the case of natural gas. Typically, broil burner 28 may produce approximately 12,000 Btu per hour. Duct 30 or conduit runs vertically along the outside of side wall 20 and communicates with a portion of air chamber 90. As shown best in FIGS. 1 and 3, a front-to-back vertical partition 120 or baffle separates at least a portion of air chamber 90 into left and right sections 118 and 119, respectively. Accordingly, primary combustion air destined for broil burner 28 travels through slots 94 and into right section 119 of combustion air chamber 90. The purpose of baffle or partition 120 is to isolate the combustion air to bake burner 26 from duct 30 and right section 119 so that, when the bake burner 26 is activated and the broil burner 28 is off, combustion products are prevented from recirculating through broil burner 28 back down duct 30 to bake burner 26. If this were permitted to happen, there could be incomplete combustion resulting in wall oven 10 producing excessive CO. Partition 120 may be in a variety of forms such as, for example, an inverted T having its horizontal members connected to the bottom of enclosure panel 92 by spot welds. Here, partition 120 runs less than the entire distance from the back wall 22 to the front because sufficient isolation between combustion air and potentially recirculating combustion products is provided by a shorter span as shown in FIG. 3.

Figure 5:
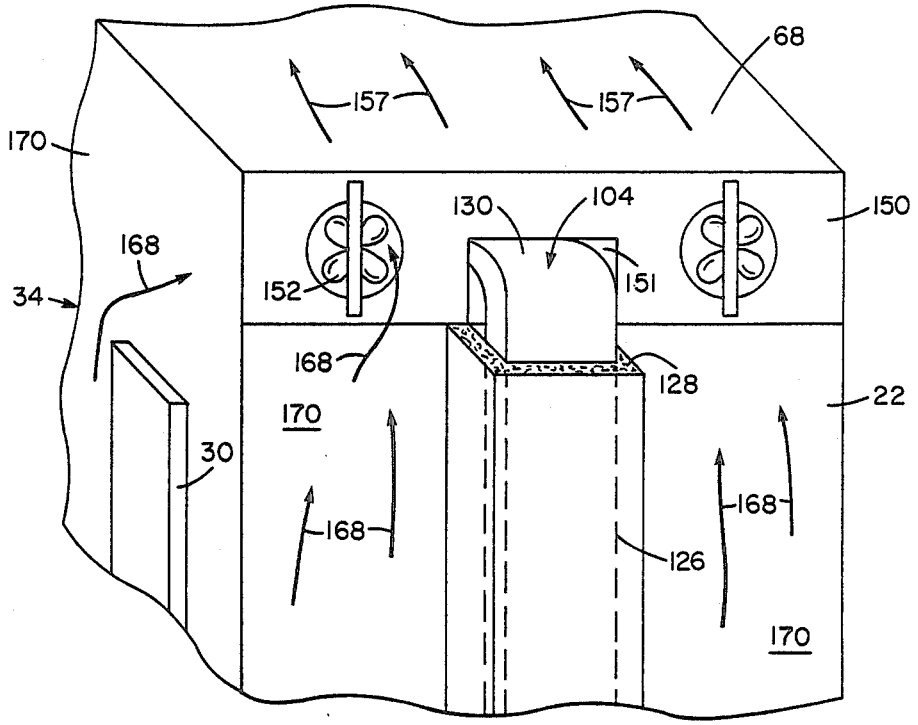
FIG. 5 is a rear perspective view of the oven with the outer casing removed.
Figure 6:
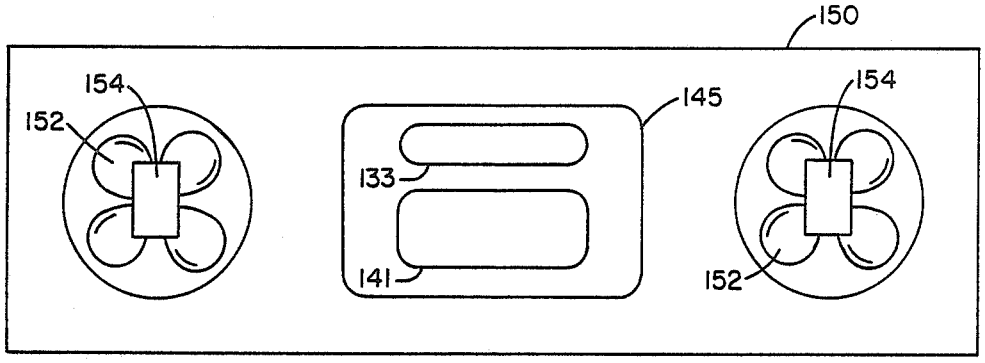
FIG. 6 is a front perspective view of a portion of the plenum behind the control panel.

Whether from bake burner 26 or broil burner 28, the combustion products in lower oven compartment 13 exit through flue pipe 104. After a relatively short horizontal section 122, flue pipe 104 takes a 90° bend 124 and couples to a vertical section 126. Still referring to FIG. 2, and also to FIG. 5 which shows a rear perspective view of oven 10 with the outer casing removed, vertical section 126 of flue pipe 104 extends upwardly along the outside of the back wall 22 of the upper oven compartment 12. Vertical section 126 or vent duct may preferably have cross-sectional dimensions of approximately 4.25×1.25 inches and may preferably be encased with an insulation material 128. At a point above top wall 14 of oven compartment 12, vertical section or duct 126 couples to inclined section 130 which inclines towards the front. Inclined section 130 communicates with flue manifold 132 or flue mixing chamber and the entrance 133 thereto may preferably be approximately 4.25×1.25 inches with rounded corners as shown in FIG. 6.

Whether from bake burner 26 or broil burner 28, the combustion products in upper oven compartment 12 exhaust through flue pipe 106 which, after a very short horizontal section 134, has a right angle bend 136 which couples to a short vertical section 138. Vertical section 138 may preferably have cross-sectional dimensions of 4.25×1 inches and couples to inclined section 140 which is underneath inclined section 130 and has larger cross-sectional dimensions such as, for example, 4.25×2.25 inches than vertical section 138. Inclined section 140 of flue pipe 106 also communicates with flue manifold 132. As shown best in FIG. 6, inclined section 140 couples to flue manifold 132 below inclined section 130 of flue pipe 104. Also, the entrance 141 of inclined section 140 is larger than the entrance 133 of inclined section 130 and may, for example, be approximately 4.25×2 inches with rounded corners.

Figure 7:
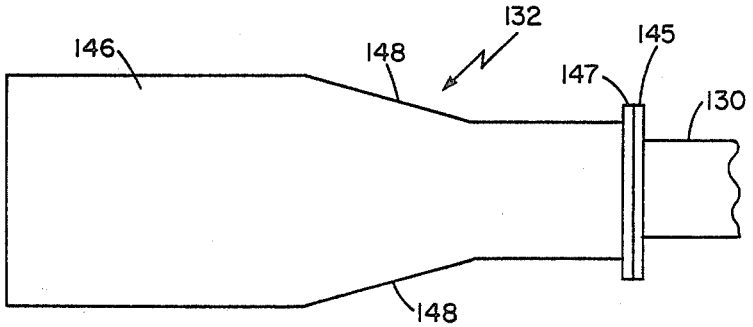
FIG. 7 is a top view of the flue manifold.

Inclined section 130 and inclined section 140 are coupled to common flue mixing chamber or flue manifold 132 because of the limited front area of oven 10 from which combustion products can be exhausted. More specifically, with a built-in wall oven, all sides are encased except for the front. Accordingly, all the combustion air and flue products must be vented through the front. As will be described later, cooling air must also be vented out the front with a self-cleaning oven. And here, with a double oven, the flue or combustion products from the two oven compartments 12 and 13 are combined or mixed so as to reduce the exhaust or vent area on the front. The lower wall 142 of flue manifold 132 inclines upwardly to flue exhaust 144 above control panel 58. Because of space limitations, the upper wall 146 of flue manifold 132 is substantially horizontal. Referring to FIG. 7, a top view of flue manifold 132 is shown. The sides 148 of flue manifold 132 expand laterally so that the cross-section of flue manifold 132 does not become too restrictive as the vertical height decreases. Also, the increased lateral width provides more area for flue exhaust 144 or vent which is restricted in height. As an example, the lateral width of flue manifold 132 may increase from approximately 7 inches at the entrances 133 and 141 of inclined sections 130 and 140 to approximately 9.75 inches at flue exhaust 144. Flanges 145 and 147 couple manifold 132 to flue pipes 104 and 106.

The cross-sectional area of inclined section 140 is significantly larger than the horizontal and vertical sections 134 and 138 of flue pipe 106 so that, when both oven compartments 12 and 13 are in operation, combustion products from inclined section 130 will not put a back pressure on the entrance 141 of flue pipe 106 into flue manifold 132. Rather, the primary restriction on flue pipe 106 is back in the horizontal and vertical sections 134 and 138 of flue pipe 106 instead of at the entrance to flue manifold 132. It has been found that with the described embodiment, flue pipe 106 does not put a back pressure on lower oven compartment 12. More specifically, flue pipe 104 has a much longer vertical section 126 than flue pipe 106 and therefore has better stack action. Accordingly, the velocity of flue or combustion products from oven compartment 13 is greater than from oven compartment 12. To compensate for the lower velocity of combustion products in flue pipe 106, inclined section 140 is made larger than corresponding inclined section 130 so as to avoid putting a back pressure on oven compartment 12.

In response to control knob 60, 62 and 64 on control panel 58, oven compartments 12 and 13 can generally be operated in either a bake, broil, or self-clean mode. In a bake mode, the oven compartment 12 or 13 is raised to a set temperature by bake burner 26 and is maintained at that temperature in response to thermal sensor 149. In the broil mode, broil burner 28 is activated so that screen 110 is heated to an incandescent temperature. The radiant energy from screen 110 is used to broil food such as meat which is positioned on racks therebelow. In the self-clean mode, latch 42 is first closed and then, it may be preferable to activate broil burner 28 for an initial time period such as 45 minutes or an hour. During this time period, a substantial percentage of the soils are vaporized and as the smoke passes over and around broil burner 28, it is further incinerated because broil burner 28 is extremely hot. Next, it may be preferable to deactivate the broil burner 28 and activate the bake burner 26 for the remainder of the self-cleaning cycle. Typically, a self-cleaning cycle may last for two or three hours and, at a temperature in the range from 900°–1100° F., the soils on the walls of the oven will degrade.

Referring to FIG. 6, there is shown a front perspective view of a portion of plenum 68 behind control panel 58. Shown in the center is a view of entrances 133 and 141 from respective flue pipes 104 and 106 into flue manifold 132. Inclined section 130 of flue pipe 104 inserts through an opening 151 in vertical partition 150. As shown in FIG. 6 and also in FIGS. 2 and 5, fans 152 having motors 154 are mounted in partition 150 on both sides of opening 151. Thermal sensors 155 are mounted on the back of respective oven compartments 12 and 13 outside the insulation 54. Although other mounting positions and/or activating temperatures could be used, thermal sensors 155 are here mounted on the top right side and are switched at 150° F. In response to either thermal sensor being switched at 150° F., fans 152 are activated and provide a forwardly directed flow of air 157 from behind partition 150 through plenum 68 and out of vents or exit apertures 156 which are below control panel 58 and exit apertures 158 which are in a horizontal section 160 adjacent to wall 162. This forced flow of air 157, as shown by the arrows, provides cooling of plenum 68 so as to reduce the temperature to which control components (not shown) are subjected. More importantly, the forced air 157 draws in outside ambient air 164 that flows across the outer surfaces of the oven compartments 12 and 13 thereby removing heat that has passed through the insulation. More specifically, oven 10 has an outer casing 166 or jacket that spacedly surrounds the outer walls and/or insulation 54 and thereby creates a chamber 170 surrounding oven compartments 12 and 13.

With respect to oven compartment 13, outside ambient air 164 is drawn in from the bottom front underneath panel 92 and flows back underneath and up air chamber 170 at the rear. Also, as shown in FIGS. 1 and 2, cooling air 168 is drawn laterally through apertures 172 up through chamber 170 along the sides of oven compartments 12 and 13. Further, there is an opening 174 at the front, and cooling outside ambient air 164 is drawn in between the top of oven compartment 13 and the bottom of oven compartment 12. Similarly, with respect to oven compartment 12, cooling air 168 flows up chamber 170 on the sides, and, on the back, up both sides of the vertical section 126 of flue pipe 104. This total flow of cooling air 168 which goes under, up the sides, and up the back of oven 10 through air chamber 170 is drawn by fans 152.

All of the sections of air chamber 170 through which cooling air 168 passes are isolated from the air paths earlier described for primary combustion air, secondary combustion air, and combustion products. Accordingly, the movement of cooling air 168 around the outside of oven 10 so as to keep the outer surfaces at acceptable temperatures does not interfere with the burning characteristics of any of the burners 26 and 28. Not only is the cooling and burning air separated, but an ample supply of both is provided through the relatively limited area on the front of a wall oven, here shown as a double wall oven.

This completes the description of the preferred embodiment. However, those skilled in the art will understand that there are a variety of modifications possible without departing from the spirit and scope of the invention. Accordingly, it is intended that the scope of the invention only be limited by the appended claims.

What is claimed is:

1. A gas wall oven, comprising:

an oven compartment comprising a top, bottom, side and back walls, and a door;

a burner box proximate said bottom;

a first burner positioned in said burner box;

means for providing secondary combustion air from the front of said oven to said burner box;

a second burner proximate said top;

means for channeling primary combustion air from the front of said oven to said second burner; and said providing means being substantially isolated from said channeling means to prevent first burner combustion products from recirculating through said second burner and said channeling means back to said first burner when said first burner is activated and said second burner is off.

2. The oven recited in claim 1 wherein said secondary combustion air providing means comprises apertures in said burner box communicating with the front of said oven.

3. The oven recited in claim 1 wherein said primary air channeling means comprises a vertical duct running along one of said side walls and communicating with the front of said oven at the bottom.

4. The oven recited in claim 3 further comprising a barrier wall between said duct and the underside of said burner box.

5. A self-clean gas wall oven, comprising:

an oven compartment comprising a top, bottom, side and back walls, and a door;

a burner box proximate said bottom;

a bake burner positioned in said burner box;

a first passageway for providing a flow of secondary combustion air from the front of said oven to said burner box for said bake burner;

a broil burner positioned proximate said top;

a duct for providing a flow of primary combustion air from the front of said oven to said broil burner; and means for preventing bake burner combustion products from recirculating through said broil burner and duct back to said bake burner when said broil burner is deactivated.

6. The oven recited in claim 5 wherein said first passageway and said duct both draw air from the front underside of said oven compartment, and said preventing means comprises a partition between the flow paths of said secondary combustion air for said bake burner and said primary combustion air for said broil burner.

7. A self-clean gas wall oven, comprising:

an oven compartment comprising a top, bottom, side and back walls, and a door;

a burner box positioned below said bottom and communicating with said compartment;

a first burner positioned in said burner box for providing combustion products for flowing into said compartment;

a chamber positioned below said burner box, said burner box having a plurality of apertures for communicating with said chamber;

said chamber communicating with the outside front of said oven for providing secondary combustion air through said apertures into said burner box for said first burner;

a second burner proximate said top;

a duct external to said oven compartment and running to a location below said compartment for providing primary combustion air from the front of said oven to said second burner; and means positioned between said duct and said air chamber for substantially preventing first burner combustion products from recirculating back to said first burner via said second burner and said duct when said second burner is off.

8. The oven recited in claim 7 wherein said preventing means comprising a vertical partition separating the input of said duct from said air chamber.

9. A gas self-clean wall oven, comprising:

an oven compartment comprising a top, bottom, side and back walls, and a door;

a burner box positioned below said bottom and communicating with said compartment;

a bake burner positioned in said burner box;

a first passageway for providing secondary combustion air from the bottom front of said oven to said bake burner in said burner box;

a broil burner positioned proximate said top of said oven compartment;

a second passageway comprising a duct for providing primary combustion air from said bottom front of said oven to said broil burner; and means for substantially isolating said first passageway from said duct so that, when said bake burner is activated and said broil burner is off, combustion products from said bake burner are prevented from recirculating through said broil burner and said duct back to said bake burner.

10. The oven recited in claim 9 further comprising an air chamber surrounding said oven and means for moving cooling air through said air chamber, said cooling air being substantially isolated from said secondary and primary combustion air.

11. A gas self-clean wall double oven, comprising:

a first oven compartment comprising a top, bottom, side and back walls, and a door;

a second oven compartment positioned below said first oven compartment and comprising a top, bottom side and back walls, and a door;

a first burner box positioned between said first and second oven compartments;

a second burner box positioned below said second oven compartment;

a first bake burner positioned in said first burner box;

a second bake burner positioned in said second burner box;

a first passageway for providing secondary combustion air from the front of said double oven between said first and second oven compartments to said first burner box;

a second passageway for providing secondary combustion air from the front of said double oven below said second oven compartment to said second burner box;

a first broil burner positioned proximate to said top of said first oven compartment;

a second broil burner positioned proximate said top of said second oven compartment;

a third passageway communicating from the front of said double oven between said first and second oven compartments to said first broil burner for providing primary combustion air;

a fourth passageway communicating from the front of said double oven beneath said second oven compartment to said second broil burner for providing primary combustion air;

means for substantially isolating said first and third passageways for preventing combustion products from recirculating through said first broil burner back to said first bake burner when said first bake burner is activated and said first broil burner is off; and means for substantially isolating said second passageway from said fourth passageway to prevent combustion products from recirculating through said second broil burner back to said second bake burner when said second bake burner is activated and said second broil burner is off.

* * * * *